US006864791B1

(12) United States Patent
Kam

(10) Patent No.: US 6,864,791 B1
(45) Date of Patent: Mar. 8, 2005

(54) SECURITY BAG

(75) Inventor: Raymond Kam, New Territories (CN)

(73) Assignee: Rackel Industries Ltd., Tsuen Wen (HK)

( * ) Notice: Subject to any disclaimer, the term of this patent is extended or adjusted under 35 U.S.C. 154(b) by 175 days.

(21) Appl. No.: 10/348,849

(22) Filed: Jan. 22, 2003

(51) Int. Cl.[7] ..... G08B 13/14
(52) U.S. Cl. ..... 340/568.7; 340/522; 340/523
(58) Field of Search ..... 340/568.7, 568.1, 340/568.2, 681.1, 687, 522, 523, 570

(56) References Cited

U.S. PATENT DOCUMENTS 4,118,692 A * 10/1978 Fitchett ..... 340/542
4,584,571 A * 4/1986 Smit et al. ..... 340/572.1
5,408,220 A * 4/1995 Brown et al. ..... 340/571
5,661,456 A * 8/1997 Staehle, Jr. ..... 340/568.7
5,748,089 A * 5/1998 Sizemore ..... 340/574
5,831,531 A * 11/1998 Tuttle ..... 340/568.2
5,920,260 A * 7/1999 Tseng ..... 340/571
5,955,948 A * 9/1999 Howell ..... 340/568.7
5,977,876 A * 11/1999 Coleman ..... 340/571
6,133,831 A * 10/2000 Kyles ..... 340/571
6,137,410 A * 10/2000 Sepulveda ..... 340/568.7
6,181,246 B1 * 1/2001 Ewing et al. ..... 340/571
6,184,788 B1 * 2/2001 Middlemiss et al. ..... 340/568.7
2003/0011466 A1 * 1/2003 Samuel et al. ..... 340/5.73
2003/0034891 A1 * 2/2003 Pedersen ..... 340/568.7
2004/0012495 A1 * 1/2004 Hammond et al. ..... 340/568.7

* cited by examiner

*Primary Examiner*—Benjamin C. Lee
(74) *Attorney, Agent, or Firm*—Alix, Yale & Ristas, LLP

(57) ABSTRACT

A security bag includes a body having an interior for receiving articles, a closure attached to or formed integrally with the body and openable to gain access to the body interior and a pair of catches closing the closure to the body. A security device co-operates with each catch to enable the closure to be opened without sounding an alarm but only when both catches are operated in unison or within a predetermined time of one another. The security device also alerts the user when the bag is not properly closed.

10 Claims, 6 Drawing Sheets

SECURITY BAG

BACKGROUND OF THE INVENTION

The present invention relates to bag or case. More particularly, although not exclusively, the invention relates to a handbag, satchel or briefcase having a pair of closing catches, each associated with an in-built security system.

Unfortunately, carrying a handbag or briefcase in public runs the risk of attracting unwanted attention from pick-pockets and bag snatchers. One is particularly at risk in crowded public areas, on public transport and in restaurants. Bags might be snatched, or tampered with in a light-fingered manner unbeknownst to the owner while the bag is still in his or her possession.

Many handbags for example have a pair of closing catches. A light-fingered bag-tamperer might open, or at least attempted to open one catch without opening, or attempting to open the other catch to gain access to the bag's interior. Similarly, a bag snatcher after escaping from the crime scene with a bag having two catches might open, or attempt to open one catch somewhat prior to opening, or attempting to open the other.

OBJECTS OF THE INVENTION

It is an object of the present invention to provide a bag or case having a pair of closing catches wired to an internal alarm system which would sound an alarm, should one of the catches be opened and the other not opened within a predetermined time interval.

It is a further object of the present invention to provide a bag or case having a pair of closing catches co-operating with one another in such a manner that both catches must be manipulated simultaneously in order to open the bag or case.

It is a further object of the present invention to alert the user when the bag is not properly closed.

Definitions

As used henceforth herein, the word "bag" is intended to encompass all sorts of handbags, cases, briefcases, satchels, suitcases, document cases, boxes, money boxes and other receptacles within which personal, confidential or valuable articles for example might be carried.

As used herein, the word "catch" is intended to encompass clips, press-studs, magnetic button tabs, locks and any other devices suitable for closing a bag.

DISCLOSURE OF THE INVENTION

There is disclosed herein a bag comprising:

a body having an interior for receiving articles, a closure attached to or formed integrally with the body and openable to gain access to the body interior, a pair of catches closing the closure to the body, and security means co-operating with each catch enabling the closure to be opened without sounding an alarm but only when both catches are operated in unison or within a predetermined time of one another.

In one form of the invention the security means might comprise a control circuit connected electrically to each catch, and a siren for sounding an alarm.

In this embodiment each catch might comprise a body-mounted component connected electrically to the control circuit and a closure-mounted component connected electrically to the control circuit and wherein each body-mounted component is connected electrically with its respective closure-mounted component when the closure is closed.

Each body-mounted component might be attracted magnetically to its associated closure-mounted component.

Preferably the predetermined time is about three or four seconds or less.

Alternatively, each body-mounted component might be latched mechanically to its associated closure-mounted component.

In this form of the invention each catch can comprise a body-mounted component and a closure-mounted component and wherein one of those components comprises first and second movable members interacting with the other component.

Preferably the first movable member of one catch is connected to the second movable member of the other catch and the second movable member of said one catch is connected to the first movable member of said other catch.

The connections might be via Bowden cables.

The movable members are preferably spring-biased into contact with said other component.

BRIEF DESCRIPTION OF THE DRAWINGS

Preferred forms of the invention will now be described by way of example with reference to the accompanying drawings, wherein.

DESCRIPTION OF THE PREFERRED EMBODIMENTS

Figure 1:
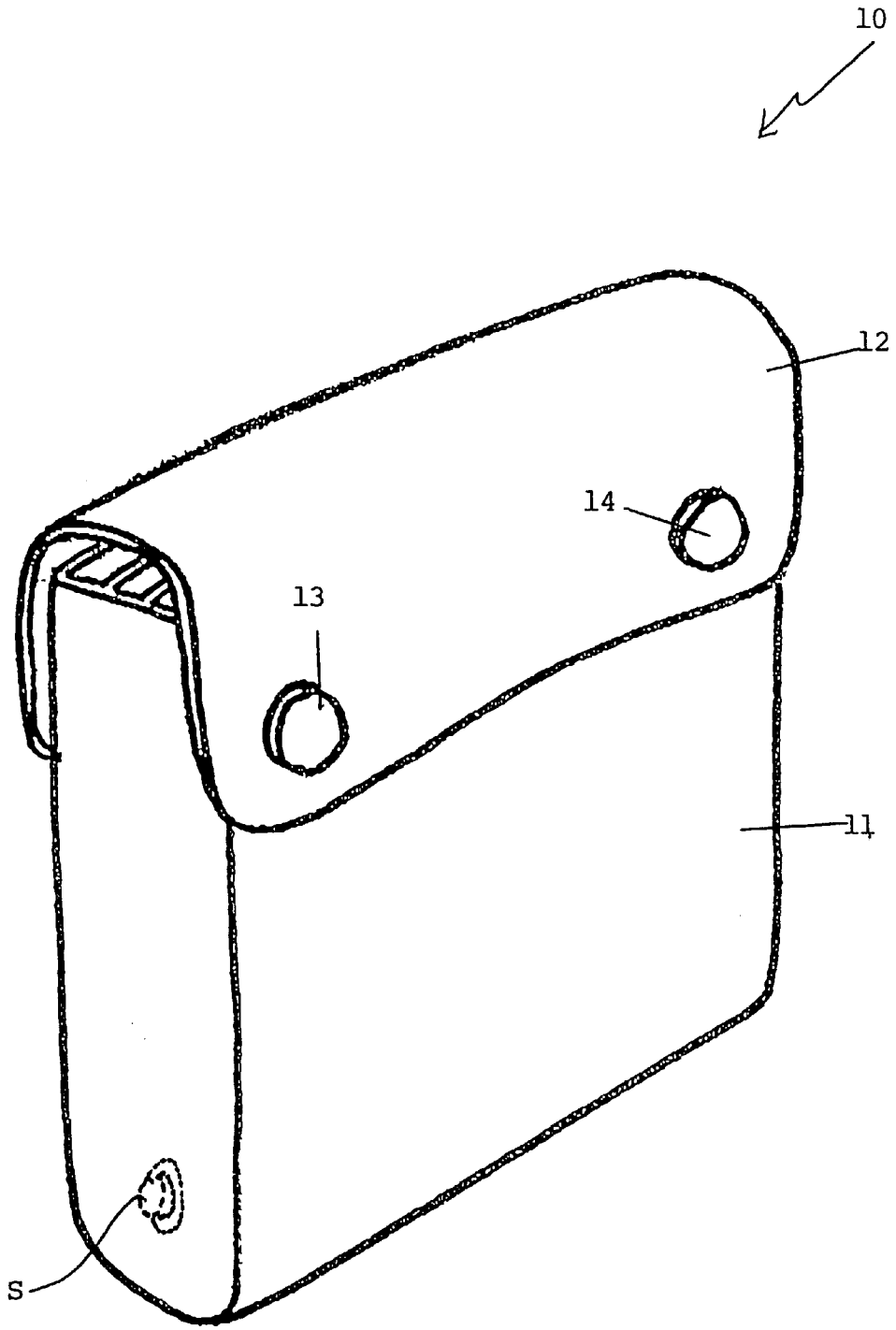
FIG. 1 is a schematic perspective illustration of a bag in having its closure in a closed configuration.
Figure 2:
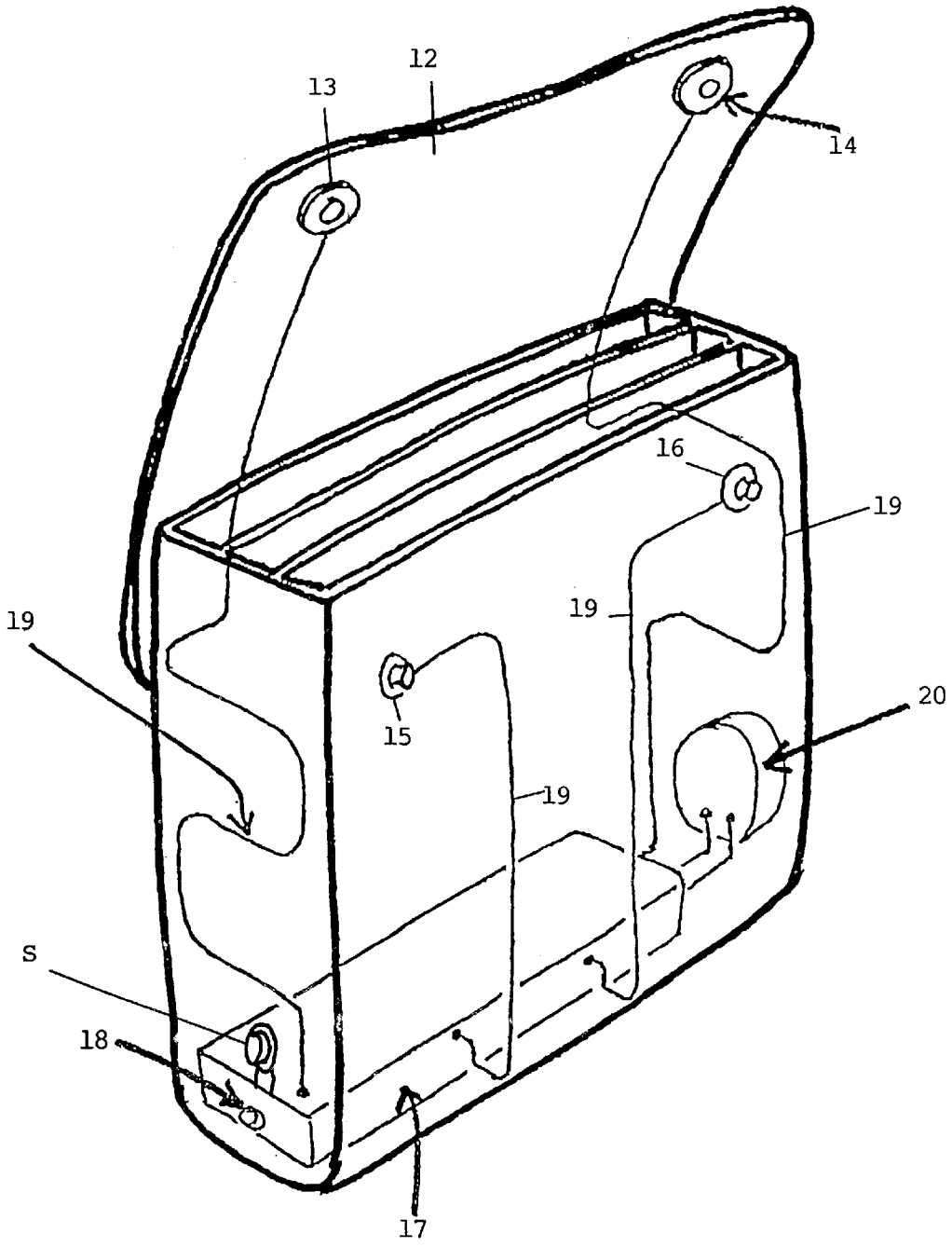
FIG. 2 is a schematic perspective illustration of the bag of FIG. 1 having its closure in an open configuration and also showing components of an internal security alarm system.
Figure 3:
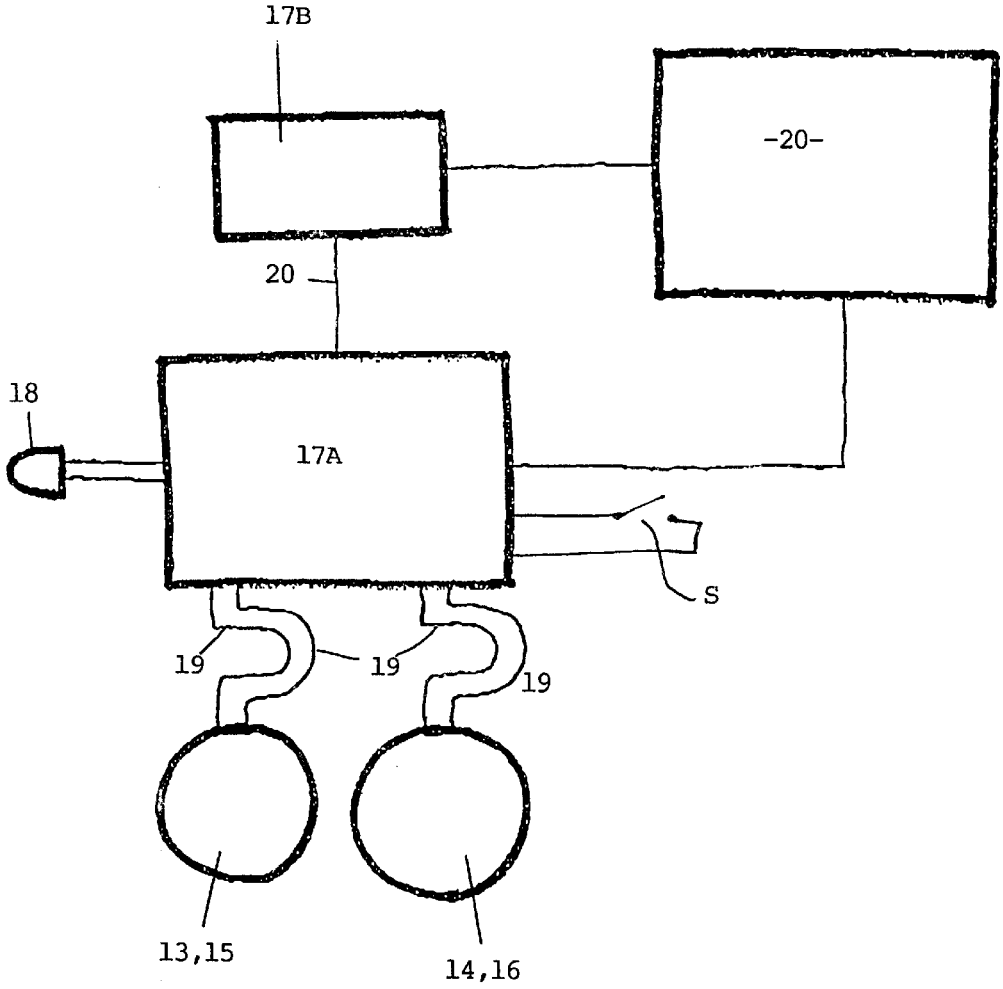
FIG. 3 is a schematic block diagram of the security alarm system of FIG. 2.

In FIGS. 1 to 3 of the accompanying drawings there is depicted schematically the bag 10. The bag 10 might be a document carrier or other bag as defined herein. It might be made of leather, fabric or synthetic material for example.

The bag 10 includes a body 11 having a closure 12 in the form of a soft flap, but this might alternatively be a rigid lid, depending upon the nature of the bag. FIG. 1 shows a pair of catch components 13 and 14 attached to the closure 12. As shown in FIG. 2, there are corresponding catch components 15 and 16 attached to the body 11. Components 15 and 16 might be attracted magnetically or mechanically to the respective components 13 and 14. No matter what actual form the catches take, there is intended to be an electrical interaction between them and therefore they ought to be metallic, or formed of other electrically conductive material, or at least have electrically conductive contact parts.

Wires 19 extent from each of the components 13, 14, 15 and 16 to a control circuit 17A that is located together with battery 17B in a pack 17. The wires would be concealed within a lining of the bag.

Figure 8:
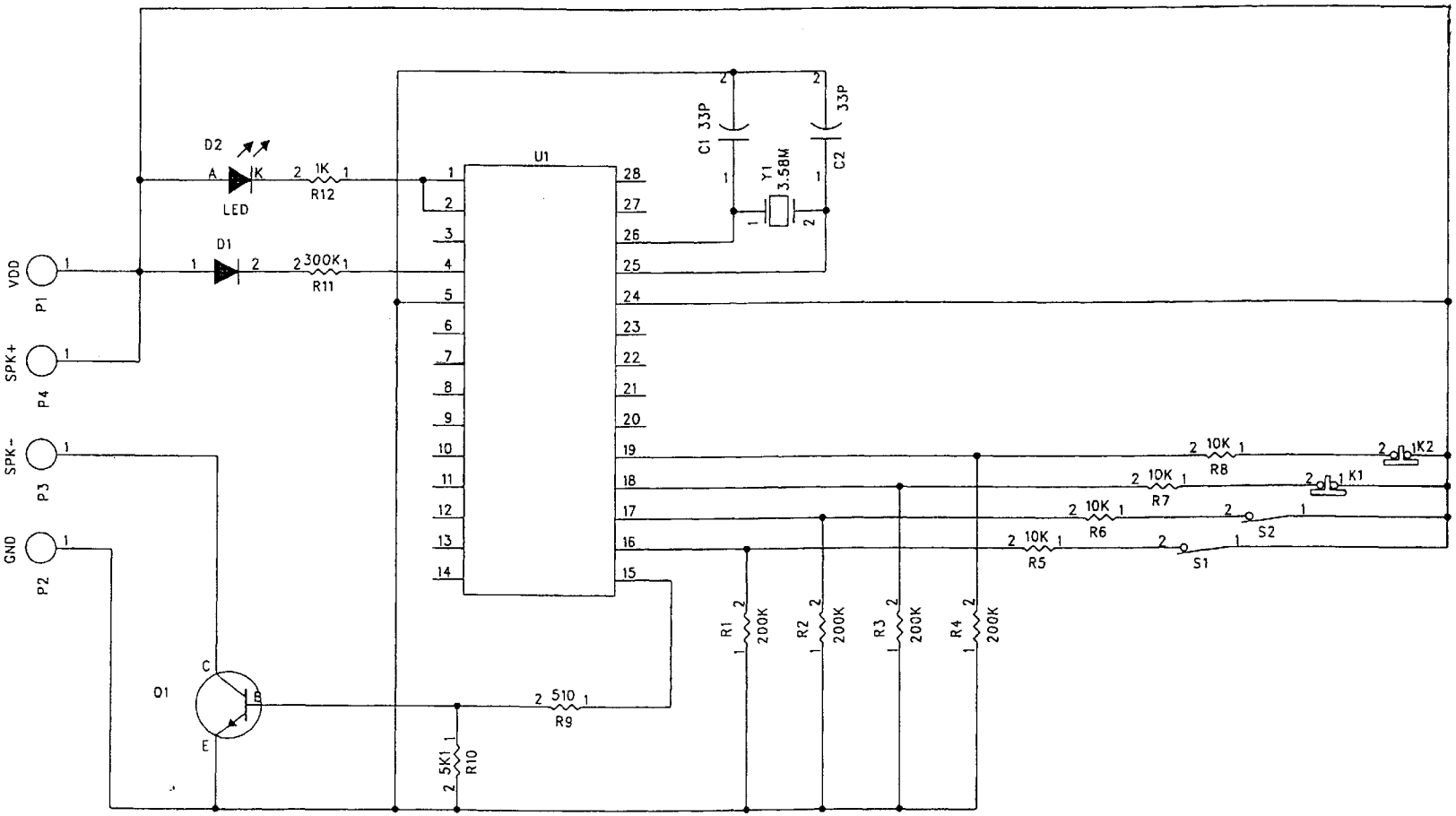
FIG. 8 is a schematic circuit diagram of the control circuitry portion of the diagram of FIG. 3.

An example of control circuitry is shown in FIG. 8 and will not be described in detail. The control circuitry 17A of FIG. 8 receives its power from the battery 17B. The battery pack 17 has a power-indication light or LED 18 visible from the bag exterior.

In an alternative construction (not shown) the LED might be visible inside the bag only. The LED might provide an indication as to the charge state of the battery and the on/off status of the circuit.

There is a siren 20 connected electrically to the control is circuit 17A by conductors. The siren 20 and its conductors would typically be concealed within the lining of the bag 10. The siren might produce different sounds. For example one tone or sound sequence might indicate tampering, another might indicate that the closure is not properly closed. Another tone or sound sequence might indicate a low battery. Another might indicate that the temporary off switch S is activated and other sounds as sequences might indicate other statuses.

The control circuitry 17A monitors for an opened electric circuit. That is, there is normally a closed electric circuit associated with each catch.

If one of the catch components 13 or 14 is lifted away from the body 11 and its associated body-mounted catch component, the control circuitry will commence a countdown, typically of three or four seconds. If the other catch is not opened before the countdown ends, the siren 20 will sound. Similarly, if one of the wire loops 19 is severed with scissors or a knife, the siren 20 will sound unless the other wire loop is severed or its associated catch opened within the predetermined time interval. When both circuits (cathces) are opened, the circuitry will commence another countdown for a predetermined period of time, say 60 seconds. When the predetermined period of time has expired and the control circuit is not reset, the alarm unit will be triggered to sound the siren in a different tone or sound sequence to alert the user that the closure of the bag is not properly closed.

The circuitry would stop monitoring for an opened circuit until both circuits are closed upon closing each catch.

Furthermore, the control circuitry can include a "temporarily off" switch S. Physically, the switch would be concealed behind the material from which the bag is made, but activatable by the application of finger pressure through that material. When the switch S is pressed, it will shut down the alarm system for a predetermined period of time, say 60 seconds. When this time has elapsed, the circuit will reset. This would assist the user to open the bag without triggering the alarm unit within the predetermined period of time. This "temporarily off" switch might be triggered by pressing it directly or by "opening and closing" either one of the catches one or more times.

According to the above, the alarm unit will not be triggered if one of the following occurs:

1. The time duration between opening the two catches within the predetermined period of time (say three or four seconds), or
2. The "temporarily off" switch is pressed/activated, or
3. Either one of the catches is "opened and closed" one time or more within the predetermined period of time.

The alarm unit will be triggered to sound the siren by one of the following actions:

1. The time duration between opening the two catches is longer than the predetermined period of time and the "temporarily off" switch is not activated.
2. One or both catches are not closed within the predetermined period of time, such as say 60 seconds, irrespective of the position of the "temporary off" switch.

The control circuit is reset and the alarm unit is silent when:

1. Both catches are closed, or
2. when the "temporary off" switch is activated and the predetermined period of time has expired.

Figure 4:
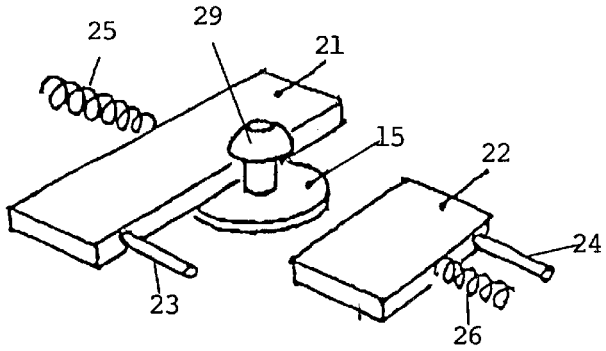
FIG. 4 is a schematic perspective illustration of a catch used in an alternative security bag.
Figure 5:
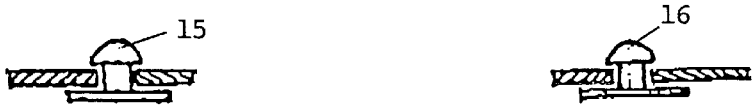
FIG. 5 is a schematic cross-sectional elevational view of two of the catches of FIG. 4, FIGS. 6A to 6C are schematic plan views of the pair of catches of FIG. 5 in various in-use configurations.
Figure 6A:
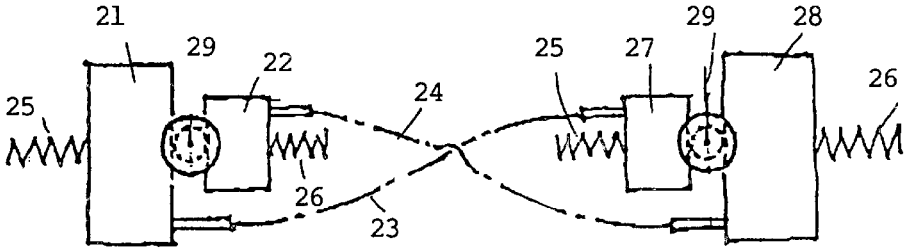

An alternative embodiment of the present invention is disclosed in FIGS. 4, 5 and 6A, B and C. In this embodiment, there is no audible alarm, but there is nevertheless a security system co-operating with each catch. One catch is shown in FIG. 4 to comprise a first catch component 15 which might be that attached to either the closure 12 or body 11. Component 15 comprises an upward extending boss 29 having a mushroom-shaped helmet. There is a pair of plates 21 and 22 spring-biased by springs 25 and 26 toward the boss 29. When either or both plates 21 and 22 are pressed against the boss 29, the catch cannot be opened as the mushroom-shaped helmet extends over an edge of the respective plate.

Figure 6B:
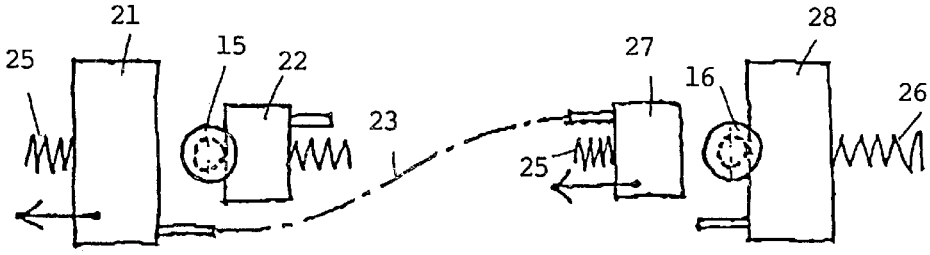
Figure 6C:
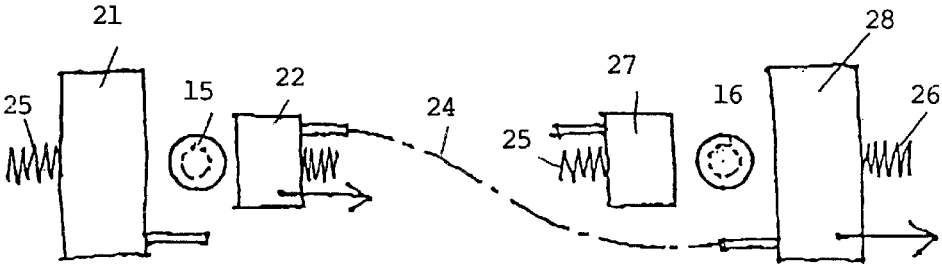

There is a Bowden cable 23 attached to plate 21 and another Bowden cable 24 attached to the plate 22. With reference to FIGS. 6A to 6C, cables 23 and 24 are reverse-associated with corresponding plate components at the other catch of the bag. The plates 21 and 28 would be associated with block-activation buttons on the bag. These buttons would have to be individually moved away from one another to open the bag. If one such button is moved away from the other, the bag could not be opened unless the other button is simultaneously moved in the opposite direction. Moreover, if plate 21 is moved to the left both it and plate 27 will move away from the respective bosses 29. However the other plates 22 and 28 will remain in contact with the respective bosses 29 unless they too a moved by manipulation of the other button (attached to plate 28). Someone intending to interfere with the bag in a light-fingered manner will not necessarily know this and therefore will not be able to open one of the catches separately.

Figure 7A:
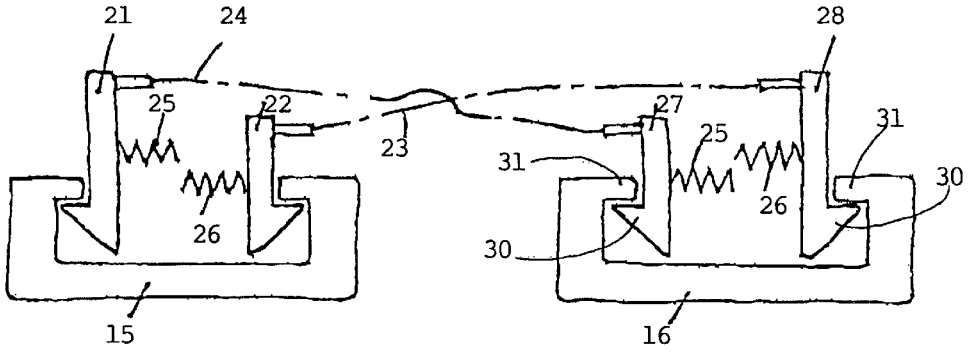
FIGS. 7A to 7C are schematic cross sectional elevational views of an alternative catch structure.
Figure 7B:
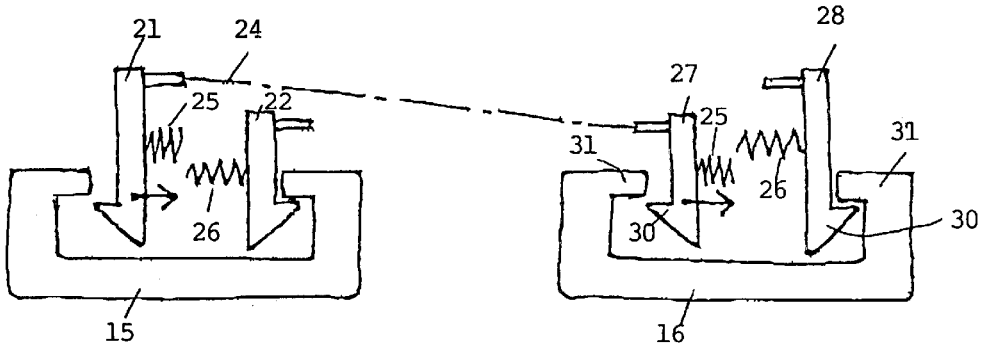
Figure 7C:
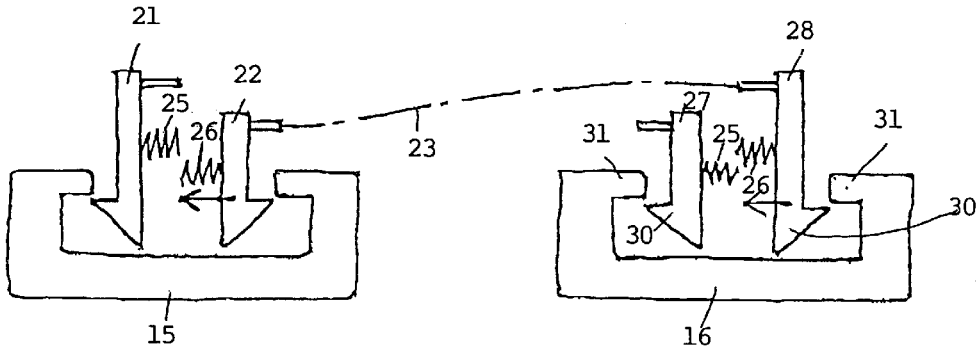

In FIGS. 7A to 7C alternative to what is shown in FIGS. 6A to 6C is shown. In this alternative, instead of movable plates 21 and 22, there are fingers 27 and 28, each having a barb 30 received beneath a lip 31 of a box or a C-shaped catch component 16. Springs 25 and 26 are shown schematically and will be anchored to the catch component 16. In all other respects, functionality of the embodiment of FIGS. 7A to 7C is the same as that of the embodiment described with reference to FIGS. 6A to 6C.

It should be appreciated that modifications and alterations obvious to those skilled in the art are not to be considered as beyond the scope of the present invention. For example, instead of using Bowden cables in the second embodiment, any mechanical linkage or even an electrical linkage via wires and solenoids could be adopted.

Furthermore, in the electromechanical embodiment (FIGS. 1 through to 4), instead of having wires attached to each component of each catch, wiring could be reduced by having a pair of conductors extending to just one of the catch components—say the body-mounted component. The body-mounted component could have a switch activated upon interaction with the closure-mounted component.

What is claimed is:

1. A bag comprising:

a body having an interior for receiving articles, a closure attached to or formed integrally with the body and openable to gain access to the body interior, a pair of catches closing the closure to the body, and security means for co-operating with each catch enabling the closure to be opened without sounding an alarm but only when both catches are operated in unison or within a predetermined time of one another; wherein said security means sounds said alarm when at least one of the catches are operated not in unison or not within said predetermined time of one another.

2. The bag of claim 1 wherein the security means comprises a control circuit connected electrically to each catch, and a siren for sounding an alarm.

3. The bag of claim 2 wherein each catch comprises a body-mounted component connected electrically to the control circuit and a closure-mounted component connected electrically to the control circuit and wherein each body-mounted component is connected electrically with its respective closure-mounted component when the closure is closed.

4. The bag of claim 3 wherein each body-mounted component is attracted magnetically to its associated closure-mounted component.

5. The bag of claim 2 wherein said predetermined time is about three or four seconds or less.

6. The bag of claim 3 wherein each body-mounted component is latched mechanically to its associated closure-mounted component.

7. The bag of claim 6 wherein each catch comprises a body-mounted component and a closure-mounted component and wherein one of those components comprises first and second movable members interacting with the other component.

8. The bag of claim 7 wherein the first movable member of one catch is connected to the second movable member of the other catch and the second movable member of said one catch is connected to the first movable member of said other catch.

9. The bag of claim 8 wherein the said connections are via Bowden cables.

10. The bag of claim 8 wherein the movable members are spring-biased into contact with said other component.

* * * * *